US007270155B2

(12) United States Patent
Ho

(10) Patent No.: US 7,270,155 B2
(45) Date of Patent: Sep. 18, 2007

(54) GASOLINE VAPOR RECYCLING SYSTEM FOR GASOLINE TANK

(76) Inventor: Wei Pin Ho, 1 Floor, No.2, Lane 442, Jhongjheng Road, Jhonghe City, Taipei County 235 (TW)

( * ) Notice: Subject to any disclaimer, the term of this patent is extended or adjusted under 35 U.S.C. 154(b) by 92 days.

(21) Appl. No.: 11/189,779

(22) Filed: Jul. 27, 2005

(65) Prior Publication Data

US 2007/0023101 A1 Feb. 1, 2007

(51) Int. Cl.
*B65B 31/00* (2006.01)

(52) U.S. Cl. ..... 141/59; 141/4; 141/45; 141/52; 141/95; 141/290

(58) Field of Classification Search ..... 141/4–7, 141/37, 43, 45, 50, 52, 53, 59, 82, 94, 95, 141/285, 290; 62/45.1, 50.1, 54.3; 95/39–41, 95/288–290; 96/221, 243; 137/587–589
See application file for complete search history.

(56) References Cited

U.S. PATENT DOCUMENTS 3,884,652 A * 5/1975 Nichols ..... 96/253
5,220,799 A * 6/1993 Lievens et al. ..... 62/48.2
5,464,466 A * 11/1995 Nanaji et al. ..... 95/45
6,174,351 B1 * 1/2001 McDowell et al. ..... 96/4
6,834,686 B2 * 12/2004 Gray et al. ..... 141/4
6,840,292 B2 * 1/2005 Hart et al. ..... 141/59

* cited by examiner

*Primary Examiner*—Timothy L. Maust
(74) *Attorney, Agent, or Firm*—Troxell Law Office PLLC

(57) ABSTRACT

A gasoline vapor recycling system for gasoline tank includes a route control valve installed on a breathing valve piping of a gasoline tank to control change of gasoline vapor path, and a discharge processing apparatus which has an intake pipe connecting to the route control valve and a gasoline return pipe connecting to the breathing valve piping via a check valve. The discharge processing apparatus has a sensor to monitor the pressure of the saturated gasoline vapor in the gasoline tank. A control element activates a delivery unit or directly actuates the route control valve to direct the gasoline vapor that otherwise will be discharged through the breathing valve piping into the discharge processing apparatus. The gasoline vapor is processed by a compressing unit and a processing unit for separating of liquid and vapor, and purifying of the vapor. A portion of the gasoline vapor flows back to the gasoline tank via the gasoline return pipe. Another portion of the gasoline vapor is purified and discharged via a vapor discharge pipe.

11 Claims, 4 Drawing Sheets

GASOLINE VAPOR RECYCLING SYSTEM FOR GASOLINE TANK

BACKGROUND OF THE INVENTION

1. Field of the Invention

The invention relates to a gasoline vapor recycling system for gasoline tank, particularly for balancing vapor pressure in a gasoline tank where gasoline vapor increases excessively as oil is discharged from a gasoline tanker to gasoline tank and processing discharged gasoline vapor through a discharge processing apparatus to purify the vapor and separate liquid gasoline to reduce pollution and hazard resulting from directly discharging the gasoline vapor and improve energy reclamation and utilization.

2. Description of the Prior Art

Gasoline is a volatile liquid fuel. The volatile gasoline vapor not only easily burns and causes the risk of fire, also is hazardous to human body and environment. Hence to process the dispersed gasoline vapor is an important safety issue on gasoline storage sites such as vapor stations. The present gasoline vapor process method at the vapor stations generally can be divided in two stages depends on gasoline vapor generation types. The first stage mainly targets the gasoline vapor in the closed gasoline tank underground. The gasoline tank generally is filled with substantial saturated gasoline vapor due to change of environmental temperature or inflow of a great amount of gasoline vapor during the gasoline tanker unloads the gasoline. As a result, the pressure in the gasoline tank is unbalanced. Hence a ventilation pipe usually is provided to communicate the gasoline tank with the ambience to discharge the gasoline vapor to balance the pressure in the tank. But such an approach directly discharges the gasoline vapor without processing into the atmosphere. It causes a great hazard to the environment. The second stage is to reclaim the gasoline vapor escaped from the gasoline nozzle while the gasoline is injected into the vehicles by a gasoline vapor recycling means mounted on the gasoline nozzle. However, the gasoline vapor reclaimed into the gasoline tank also encounters the problem of the first stage previously discussed. A breathing pipe has to be used to release the pressure and pollution and safety issues still exist.

At present gasoline delivery and distribution usually is done by transporting the gasoline through gasoline tankers from the refinery to gasoline tanks in gasoline depots located on different locations. During the process of unloading the gasoline from the gasoline tanker into the gasoline tank, a great amount of gasoline vapor is generated and evaporates from the gasoline tank. Some gasoline tankers have gasoline vapor recycling apparatus to reclaim the gasoline vapor through another piping into the gasoline tanker. The reclaimed gasoline vapor is transported to the refinery or gasoline storage to be recycled to liquid type gasoline again through condensation, adsorption by active carbon, film separation or the like. Although the aforesaid gasoline vapor recycling method on the gasoline tanker can reduce gasoline vapor escape and air pollution, the recycled gasoline vapor is transformed to gasoline and sold to the refinery. It is a great loss to the buyers such as the vapor stations.

SUMMARY OF THE INVENTION

The primary object of the present invention is to solve the environmental and personnel hazards resulted from directly volatized gasoline vapor increased as oil is discharged from a gasoline tanker to a gasoline tank, and economic loss caused by gasoline evaporation or reclamation of the gasoline tankers.

The present invention provides a gasoline tank gasoline vapor recycling system that employs the existing breathing pipe in the gasoline tank to direct the reclaimed gasoline vapor into the gasoline tank to be reused to reduce the loss of owner and prevent the gasoline vapor from being directly discharged to avoid environmental pollution and hazard. The gasoline tank gasoline vapor recycling system according to the invention includes a route control valve on a breathing valve piping of a gasoline tank that can change the path of gasoline vapor, a discharge processing apparatus connecting to the route control valve that includes a sensor to monitor the gasoline vapor pressure, temperature and liquid level, a control element responsive to the detected conditions of the sensor to control the route control valve to change the path of the gasoline vapor and activate operation of the discharge processing apparatus, and a compression unit and a processing unit to process the intake gasoline vapor. There is also a gasoline return pipe containing a check valve that is connected to the breathing pipe to channel the reclaimed gasoline to the gasoline tank, and a vapor discharge pipe connecting to the processing unit which separates the liquid and vapor to discharge the purified vapor.

By means of the aforesaid system, when the sensor detects increase of the gasoline vapor pressure, the control element activates a transporting unit or directly activates the route control valve so that the saturated gasoline vapor which is supposed to be discharged through a vapor pipe for balancing purpose is directed by the route control valve, and enters through an intake pipe to the discharge processing apparatus to be processed for separating liquid and vapor, and purification. The processed and reclaimed liquid gasoline flows to the gasoline tank via the gasoline return pipe. The vapor is purified and discharged via the vapor discharge pipe.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
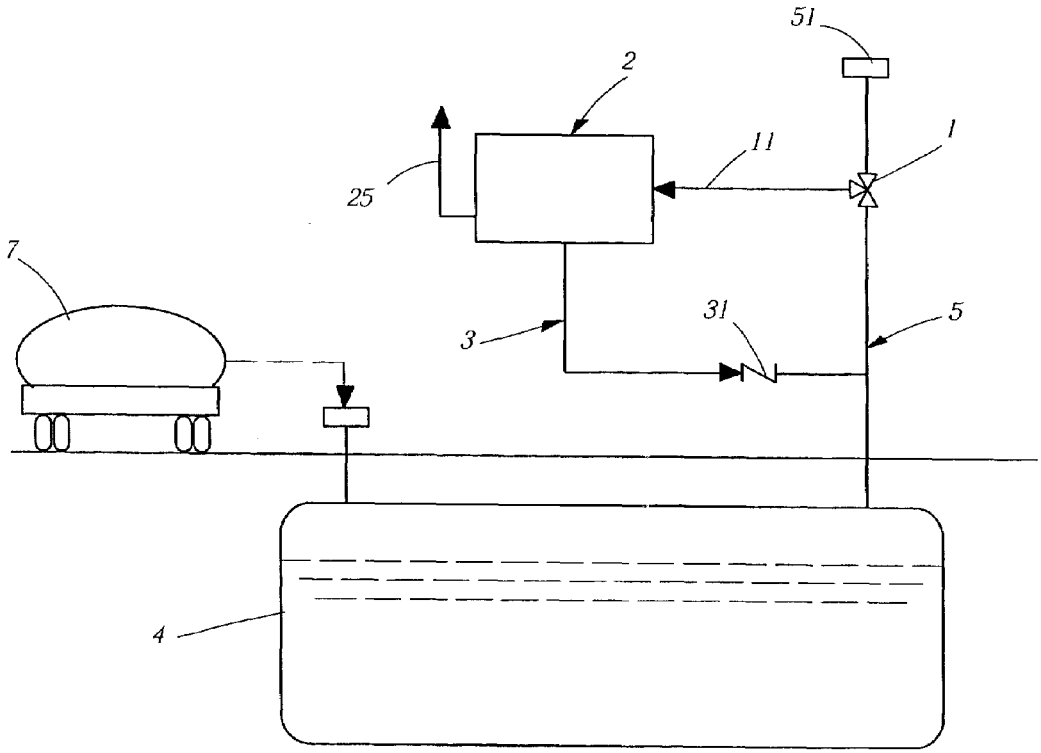
FIG. 1 is a schematic view of a first embodiment of the system of the invention.
Figure 2:
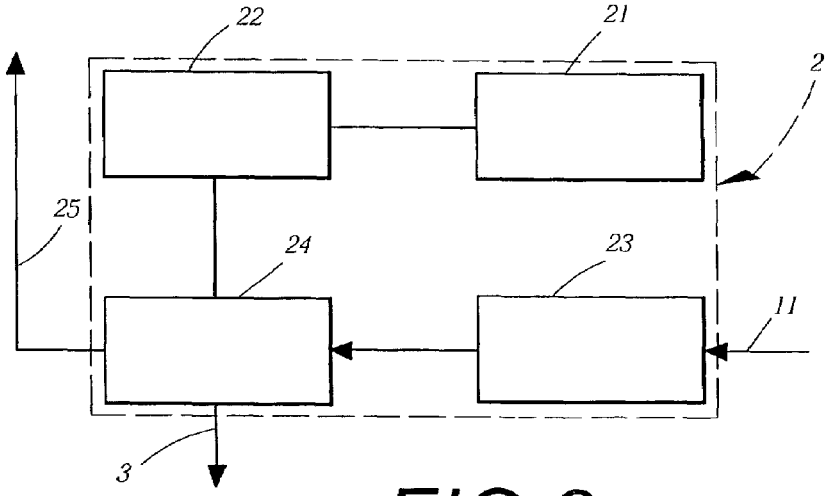
FIG. 2 is a structural block diagram of the gasoline vapor discharge processing apparatus of the invention.

Refer to FIGS. 1 and 2 for a first embodiment of the system. It is adopted for a gasoline tank 4 where gasoline vapor is increased excessively as oil is discharged from a gasoline tanker 7 and breathing valve piping is the only way for gasoline vapor balancing/discharging. It mainly includes a route control valve 1 and a discharge processing apparatus 2. As shown in FIG. 1, the gasoline processed and reclaimed by the discharge processing apparatus 2 flows back to a gasoline tank 4 through a gasoline return pipe 3 and the breathing valve piping 5 which directs the gasoline vapor to the gasoline tank 4 in normal conditions.

The route control valve 1, as shown in FIG. 1, is located on the breathing valve piping 5 which aims to discharge the gasoline vapor. The route control valve 1 may be a three-way control valve to change the path of the gasoline vapor and direct the gasoline vapor to the discharge processing apparatus 2 through an intake pipe 11.

The discharge processing apparatus 2, as shown in FIG. 2, includes a sensor 21 to monitor alterations of gasoline vapor pressure, temperature and liquid level in the gasoline tank 4, and compare the detected values constantly with set standard values to determine whether to proceed pressure balancing process. A control element 22 is provided to receive and compare the monitored values detected by the sensor 21, and activate related controls when the monitored values reach or exceed the set standard values. Namely a compression unit 23 and a processing unit 24 are activated simultaneously to perform recycling operation, and the route control valve 1 is activated to alter the gasoline vapor path to transfer the gasoline vapor that otherwise will be discharged to the atmosphere to the compression unit 23 of the discharge processing apparatus 2. The compression unit 23 has an input end connecting to the route control valve 1 through the intake pipe 11 so that the gasoline vapor may be directed and compressed. The processing unit 24 is connected to an output end of the compression unit 23 to separate liquid and vapor gasoline, and purify the vapor. The processing unit 24 is connected to the breathing valve piping 5 via the gasoline return pipe 3 which contains a check valve 31. In addition, the processing unit 24 has a rear end connecting to a vapor discharge pipe 25 which is leading to the atmosphere.

In the first embodiment shown in FIGS. 1 and 2, the process is performed on the existing piping of the gasoline tank 4. Hence there is no need to make many changes on the existing piping. The alteration merely includes installing the route control valve 1 on the existing breathing valve piping 5 to connect to the discharge processing apparatus 2. The discharge processing apparatus 2 is connected to the gasoline return pipe 3 to form a closed gasoline vapor recycling system. The operation of the gasoline vapor recycling system is as follow:

The sensor 21 of the discharge processing apparatus 2 constantly monitors the gasoline vapor pressure of in gasoline tank 4. Due to gasoline unloading or rising of environmental temperature, if the internal gasoline vapor pressure of the gasoline tank 4 detected by sensor 21 reaches or exceeds a preset discharge value, the control element 22 of the discharge processing apparatus 2 immediately activates the compression unit 23 and processing unit 24 to actuate the route control valve 1 to change the gasoline vapor path. The gasoline vapor enters the compression unit 23 of the discharge processing unit 2 through the intake pipe 11 and is compressed. The compressed gasoline vapor is sent to the processing unit 24 to separate liquid and vapor gasoline, and perform vapor purification. The processed liquid gasoline flows back to the gasoline tank 4 through the gasoline return pipe 3 and breathing valve piping 5. Hence the gasoline vapor which otherwise will be discharged and lost can be reclaimed and reused. The processed vapor is discharged through the vapor discharged pipe 25. The discharged vapor does not contain gasoline vapor or hazardous material, thus does not threat the atmospheric environment or people.

Figure 3:
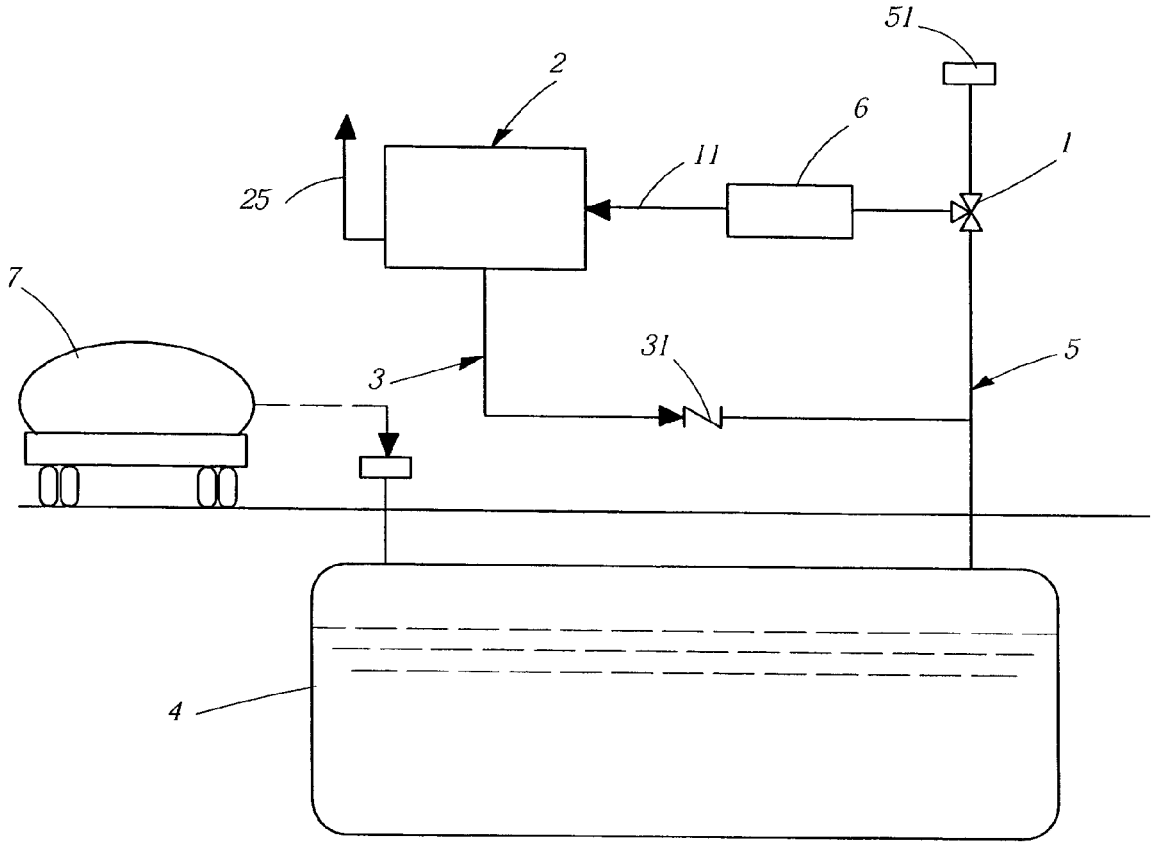
FIG. 3 is a schematic view of a second embodiment of the system of the invention.

Refer to FIG. 3 for a second embodiment of the invention. It is also adopted for a gasoline tank environment where gasoline vapor is increased excessively as oil is discharged from a gasoline tanker 7 to gasoline tank 4 and breathing valve piping is the only way for gasoline vapor balancing/discharging. However, it further includes a delivery apparatus 6 to transport the gasoline vapor to the discharge processing apparatus 2 by force. In this embodiment, the recycle system, like the first embodiment, also includes a route control valve 1, a discharge processing apparatus 2, and a vapor discharge pipe 25 connecting to the discharge processing apparatus 2, and a gasoline return pipe 3 connecting to the discharge processing apparatus 2 and the breathing valve piping 5. The delivery apparatus 6 is located on the intake pipe 11 which bridges the route control valve 1 and the discharge processing apparatus 2 to send the gasoline vapor to the discharge processing apparatus 2 by force. The delivery apparatus 6 may be a blower or compressor or the like. By means of the delivery apparatus 6, the gasoline vapor in the gasoline tank 4 may be transported to the discharge processing apparatus 2 without being discharged to the atmosphere through the breathing valve 51 at the distal end of the breathing valve piping 5.

Referring to FIGS. 2 and 3 for the operation of the second embodiment. When the sensor 21 of the discharge processing apparatus 2 detects increase of the gasoline vapor pressure in the gasoline tank 4, the delivery apparatus 6 is activated immediately. Gasoline vapor in the gasoline tank 4 that otherwise will be discharged through the breathing valve piping 5 is delivered under force via the intake pipe 11 to the discharge processing apparatus 2. The gasoline vapor entering the discharge processing apparatus 2, like that in the first embodiment, is compressed by the compression unit 23, then is sent to the processing unit 24 for separating of liquid and vapor, and purifying of the vapor. The liquid gasoline flows back to the gasoline tank 4 through the gasoline return pipe 3 and breathing valve piping 5. The processed and purified vapor is discharged through the vapor discharge pipe 25. During drawing the gasoline vapor forcefully by the delivery apparatus 6, the breathing valve 51 of the breathing valve piping 5 provides one-way discharge function without drawing external air. In other possible embodiments of the invention, the delivery apparatus 6 may also be installed on the gasoline return pipe 3 (now shown in the drawings) to delivery the liquid gasoline into the gasoline tank 4 by force.

Figure 4:
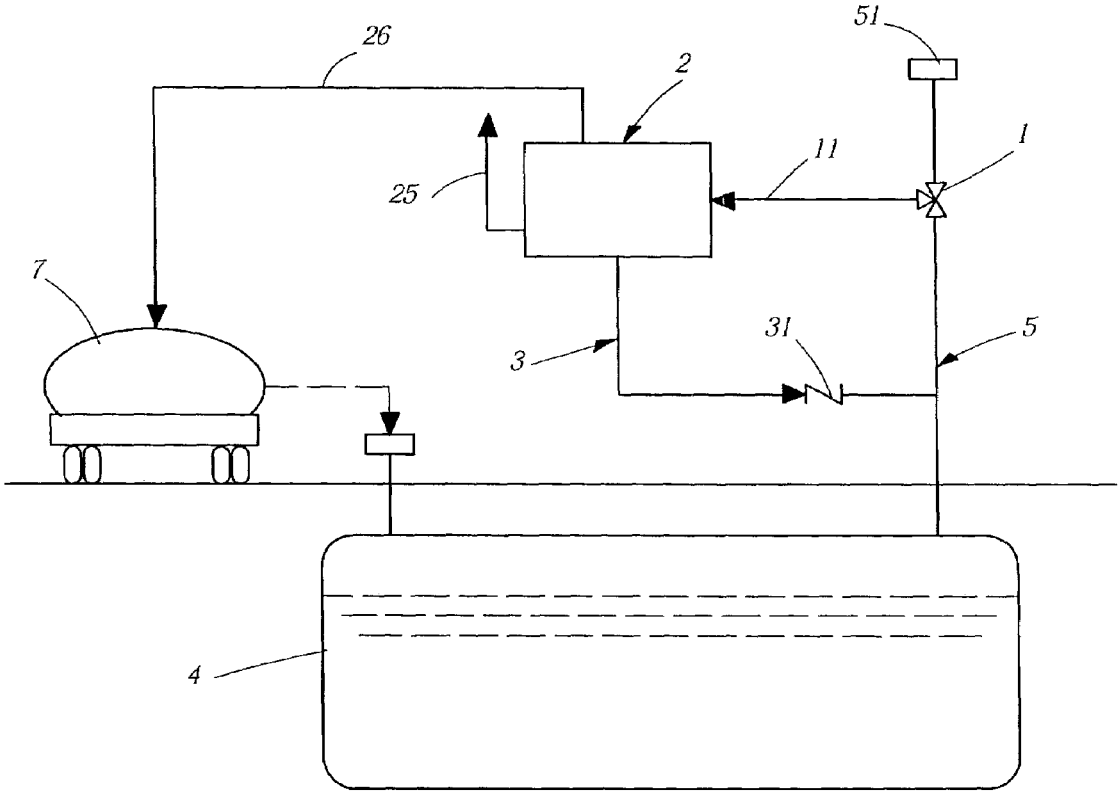
FIG. 4 is a schematic view of a third embodiment of the system of the invention.

That through present is increased vapor fully recycled to the vapor station is demonstrated in the first and second embodiments. However, for the gasoline tank or gasoline tanker that already has a closed gasoline recycling system, the invention may also be adopted to recycle the gasoline vapor that otherwise will be reclaimed by the gasoline tanker. By means of the invention a portion of liquid gasoline reclaimed from the gasoline vapor flows back to the gasoline tank so that this invention can reduce the loss that might otherwise be carried away by the gasoline tanker. Refer to FIG. 4 for a third embodiment of invention for such purpose. The discharge processing apparatus 2 and route control valve 1 of the invention bridge the gasoline tank 4 and a gasoline tanker 7. The embodiment shown in FIG. 4 is a variation of the first embodiment. The discharge processing apparatus 2 has a connection pipe 26 to be connected to the gasoline tanker 7 to send the gasoline vapor which cannot be processed by the discharge processing apparatus 2 to the gasoline tanker 7.

Operation of the third embodiment is like that shown in FIGS. 2 and 4. When the sensor 21 of the discharge processing apparatus 2 detects increase of the gasoline vapor pressure in the gasoline tank 4 while the gasoline tanker 7 is unloading the gasoline, the discharge processing apparatus 2 is activated immediately to receive the gasoline vapor. Besides delivering the gasoline vapor to the discharge processing apparatus 2 by nature, a forced vapor delivery apparatus 6 as the one shown in the embodiment 2 may also be added to transport the gasoline vapor to the discharge processing apparatus 2. The gasoline vapor sent to the discharge processing apparatus 2 is compressed, then the compressed gasoline vapor is sent to the processing unit 24 for separating liquid and vapor, and purifying the vapor. The processed liquid gasoline flows back to the gasoline tank 4 via the gasoline return pipe 3. In this embodiment a greater amount of saturated gasoline vapor is generated during gasoline unloading. To process all the gasoline vapor increased during this period, the system power of the system has to increase substantially. A higher cost incurs. Hence the system of the invention does not aim to reclaim all of the gasoline vapor for the vapor station. The system may be designed to partly reclaim the gasoline vapor in an economic condition to the business owner. In such a condition, as the embodiment shown in FIG. 4, a portion of clean vapor after processed by the processing unit 24 is discharged to the atmosphere via the vapor discharge pipe 25. Another portion of gasoline vapor not being processed is sent to the gasoline tanker 7 through the discharge processing apparatus 2 and connection pipe 26. By means of aforesaid system, a portion of gasoline vapor that might otherwise be taken by the refinery can be reclaimed by the vapor station. This embodiment can be implemented by making merely a small change of the existing piping of the vapor station.

Figure 5:
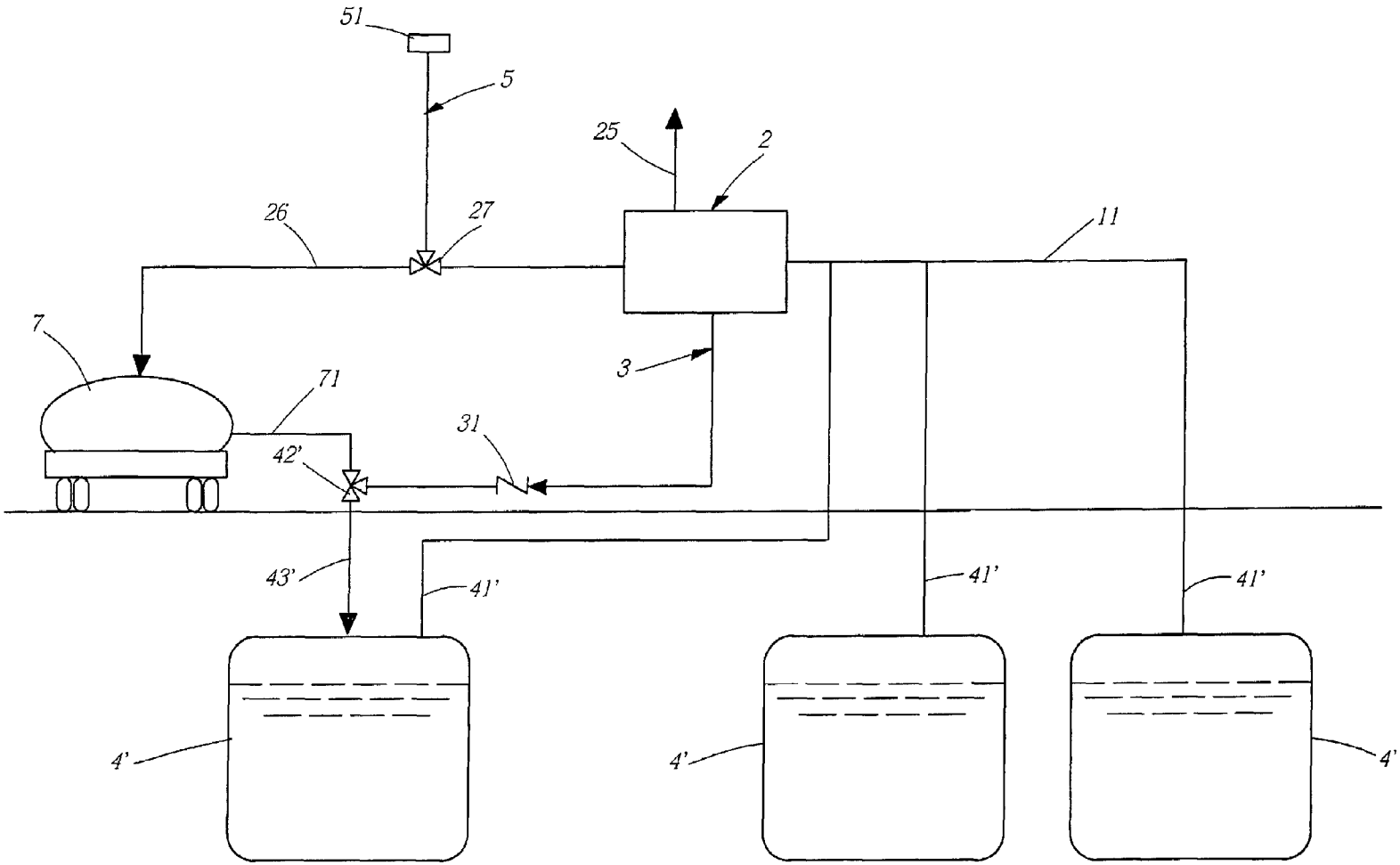
FIG. 5 is a schematic view of a fourth embodiment of the system of the invention.

The third embodiment shown in FIG. 4 may also be implemented in another fashion in an environment of multiple gasoline tanks. Referring to FIG. 5, the gasoline tanker 7 unloads the gasoline to a gasoline tank 4 via a delivery pipe 71, a three-way valve 42' and an intake pipe 43' of the gasoline tank 4'. The gasoline vapor of the gasoline tank 4' flows into the discharge processing apparatus 2 through a vapor discharge pipe 41' of the gasoline tank 4' and the intake pipe 11. The gasoline vapor entered the discharge processing apparatus 2 is processed like that in the first embodiment. The generated liquid gasoline flows to the gasoline tank 4' via the gasoline return pipe 3, a check valve 31, a three-way valve 42' and a gasoline intake pipe 43'. The processed clean vapor is discharged through the vapor discharge pipe 25. Moreover, a portion of gasoline vapor not being processed is sent back to the gasoline tanker 7 via a three-way valve 27 and the connection pipe 26.

While the preferred embodiments of the invention have been set forth for the purpose of disclosure, modifications of the disclosed embodiments of the invention as well as other embodiment thereof may occur to those skilled in the art. Accordingly, the appended claims are intended to cover all embodiments which do not depart from the spirit and scope of the invention.

I claim:

1. A gasoline vapor recycling system for gasoline tank, comprising:

a route control valve installed on a breathing valve piping extended from a gasoline tank;

a discharge processing apparatus connecting to the route control valve; and a gasoline return pipe connecting to the discharge processing apparatus and being extended to the gasoline tank through the breathing valve piping, wherein the discharge processing apparatus further includes:

a sensor;

a control element connecting to the sensor;

a compression unit having an input end connecting to the route control valve; and a processing unit connecting to an output end of the compression unit and the breathing valve piping via the gasoline return pipe and having a rear end connecting to a vapor discharge pipe, wherein the discharge processing apparatus further includes a gasoline vapor reclaiming pipe connecting to a gasoline tanker, the discharge processing apparatus being configured to reclaim gasoline vapor by compressing the vapor to substantially prevent the vapor from flowing back to the tanker.

2. The gasoline vapor recycling system of claim 1, wherein the route control valve is a three-way control valve.

3. The gasoline vapor recycling system of claim 1, wherein the gasoline return pipe contains a check valve.

4. The gasoline vapor recycling system of claim 1, wherein the route control valve and the discharge processing apparatus are bridged by a gasoline vapor delivery apparatus.

5. The gasoline vapor recycling system of claim 1, wherein the gasoline return pipe further includes a gasoline vapor delivery apparatus.

6. The gasoline vapor recycling system of claim 4, wherein the gasoline vapor delivery apparatus is a blower.

7. The gasoline vapor recycling system of claim 4, wherein the gasoline vapor delivery apparatus is a compressor.

8. The gasoline vapor recycling system of claim 4, wherein the gasoline vapor delivery apparatus is a power vapor suction apparatus.

9. The gasoline vapor recycling system of claim 5, wherein the gasoline vapor delivery apparatus is a blower.

10. The gasoline vapor recycling system of claim 5, wherein the gasoline vapor delivery apparatus is a compressor.

11. The gasoline vapor recycling system of claim 5, wherein the gasoline vapor delivery apparatus is a power vapor suction apparatus.

* * * * *